US008239996B2

(12) United States Patent
Garbers et al.

(10) Patent No.: US 8,239,996 B2
(45) Date of Patent: Aug. 14, 2012

(54) TOOTHBRUSH COMPRISING INCLINED AND TAPERED BRISTLES

(75) Inventors: Christine Garbers, Lörrach (DE); André Brunella, Lupsingen (CH); Peter Gross, Sempach (CH)

(73) Assignee: GABA International AG (CH)

( * ) Notice: Subject to any disclaimer, the term of this patent is extended or adjusted under 35 U.S.C. 154(b) by 963 days.

(21) Appl. No.: 11/997,951

(22) PCT Filed: Aug. 3, 2006

(86) PCT No.: PCT/CH2006/000405

§ 371 (c)(1),
(2), (4) Date: Feb. 5, 2008

(87) PCT Pub. No.: WO2007/016802

PCT Pub. Date: Feb. 15, 2007

(65) Prior Publication Data

US 2008/0271276 A1 Nov. 6, 2008

(30) Foreign Application Priority Data

Aug. 8, 2005 (CH) ..... 1307/05

(51) Int. Cl.
*A46B 9/04* (2006.01)

(52) U.S. Cl. ..... 15/167.1; 15/191.1; 15/DIG. 5

(58) Field of Classification Search ..... 15/167.1, 15/186, 187, 188, DIG. 5, 191.1; D4/104, D4/112, 130
See application file for complete search history.

(56) References Cited

U.S. PATENT DOCUMENTS

| | | | | |
|---|---|---|---|---|
| 164,353 | A * | 6/1875 | Wayne | 15/167.1 |
| 804,680 | A * | 11/1905 | Smith | 15/188 |
| 871,121 | A * | 11/1907 | D'Humy | 601/135 |
| 1,661,713 | A * | 3/1928 | Barker | 15/188 |
| 1,670,342 | A * | 5/1928 | Chandler | 15/188 |
| 2,645,804 | A * | 7/1953 | Gantz et al. | 15/187 |
| 3,085,273 | A | 4/1963 | Cowan | |
| 3,100,309 | A * | 8/1963 | Gambino | 15/167.1 |
| 3,359,588 | A * | 12/1967 | Kobler | 15/110 |
| 3,886,619 | A * | 6/1975 | Natman et al. | 15/187 |
| 4,493,126 | A * | 1/1985 | Uy | 15/186 |
| 5,669,097 | A * | 9/1997 | Klinkhammer | 15/167.1 |
| 5,902,955 | A | 5/1999 | Rossmann | |
| 6,053,734 | A | 4/2000 | Savill | |

(Continued)

FOREIGN PATENT DOCUMENTS

CN 2143429 10/1993

(Continued)

OTHER PUBLICATIONS

First Office Action issued by the Chinese Patent Office on Mar. 22, 2010 for corresponding Chinese Patent Application No. 200680029101.5.

(Continued)

*Primary Examiner* — Randall Chin
(74) *Attorney, Agent, or Firm* — Judy W. Chung

(57) ABSTRACT

A brush head and a toothbrush having a brush head with inclined and tapered bristles. In one aspect, the toothbrush includes a grip part, a head part, and a bristle area with tufts of bristles that are inserted therein. At least one of said tufts of bristles is inclined. The brush head is characterized in that the bristles in the at least one inclined tufts of bristles is tapered.

19 Claims, 6 Drawing Sheets

U.S. PATENT DOCUMENTS

| | | | | |
|---|---|---|---|---|
| 6,272,714 | B2 * | 8/2001 | Beals | 15/167.1 |
| 6,546,586 | B2 | 4/2003 | Cho | |
| 6,792,642 | B2 * | 9/2004 | Wagstaff | 15/160 |
| 2002/0023658 | A1 * | 2/2002 | Gueret | 132/218 |
| 2004/0070258 | A1 | 4/2004 | Kwon | |
| 2005/0172436 | A1 * | 8/2005 | Wineberg | 15/167.1 |

FOREIGN PATENT DOCUMENTS

| | | | |
|---|---|---|---|
| DE | 9012603 | | 2/1992 |
| DE | 102 38 672 | * | 12/2003 |
| EP | 0405204 | | 1/1991 |
| EP | 0 596 633 | B1 | 12/1997 |
| EP | 0885573 | | 12/1998 |
| EP | 1234525 | | 8/2002 |
| FR | 683311 | | 6/1930 |
| FR | 2559361 | | 8/1985 |
| FR | 2624360 | | 6/1989 |
| JP | 61-10495 | | 4/1986 |
| JP | 5-15834 | | 3/1993 |
| JP | 2004-129683 | | 4/2004 |
| KR | 130932 | | 4/1998 |
| RU | 2081627 | | 6/1997 |
| WO | WO 99/23910 | | 5/1999 |
| WO | WO 00/64307 | | 11/2000 |
| WO | WO 2004/049860 | | 6/2004 |
| WO | 2004056235 | | 7/2004 |

OTHER PUBLICATIONS

Office Decision of Grant issued by the Patent Office of the Russian Federation on Mar. 23, 2010 for corresponding Russian Patent Application No. 2008109020.

Imfeld et al., "In vitro investigation of the mechanical effects of manual toothbrushes on the Swiss market," Acta Med Dent Helv 5:37-47, 2000. (English translation provided).

* cited by examiner

TOOTHBRUSH COMPRISING INCLINED AND TAPERED BRISTLES

CROSS-REFERENCE TO RELATED APPLICATIONS

This application is a national stage entry under 35 U.S.C. §371 of International Patent Application No. PCT/CH2006/000405, filed 3 Aug. 2006, which claims priority to Swiss Patent Application No. 1307/05, filed 8 Aug. 2005, both of which are incorporated herein by reference.

The present invention relates to brush heads for toothbrushes, in which some of the tufts are inclined.

Toothbrushes comprising a mixed trim of tufts projecting vertically upward from the bristle carrier, on the one hand, and of inclined tufts crossing over one another in an x-shaped manner, on the other hand, are known from EP-A-0 885 573. The applicant of the present application sells three toothbrushes of this type throughout Europe under the names Elmex Inter X, Elmex Inter X Sensitive and Elmex Inter X Junior. These toothbrushes are distinguished from a brush comprising solely tufts standing vertically or solely tufts crossed in an x-shaped manner by a good cleaning performance both on the tooth surfaces and in the tooth interspaces.

In order to achieve as planar a cleaning surface of the tufts as possible, toothbrushes, after being made, whether with vertical tufts, with x-shaped tufts or with the abovementioned mixed trim, are, as a rule, trimmed to a height which is uniform within a tuft. If desired, the trimmed bristle ends are subsequently rounded mechanically, in order to reduce the risk of injury to the gums.

Recently, toothbrushes with what are known as "tapered" bristles have become known, for example from EP-A-0 596 633, the tapered bristles being arranged in tufts standing vertically. Tapered bristles are more flexible than conventional bristles and therefore allow a more careful cleaning of the tooth surfaces along with a lower risk of injury. However, after the brush has been made, tapered bristles cannot be trimmed to the same height, since the tapered part of the bristles would thus be at least partially lost.

The object of the present invention was a further improvement of the bristle heads for toothbrushes.

This object is achieved by means of a brush head for a toothbrush, which brush head has a grip part, a head part and a bristle surface with bristle tufts inserted into it, at least one of these tufts being inclined, characterized in that in at least one of the inclined tufts at least a part of the bristles is tapered.

Preferred embodiments may be gathered from the subclaims.

It was found, surprisingly, that the cleaning performance on the tooth surfaces is increased and, at the same time, a more careful cleaning of the tooth surface is possible, when, in a brush comprising a mixed vertically standing/inclined trim according to EP-A-0 885 573 not the vertically standing tufts (as would be proposed by EP-A-0 596 633) but instead the inclined tufts are provided with tapered bristles.

Figure 1:
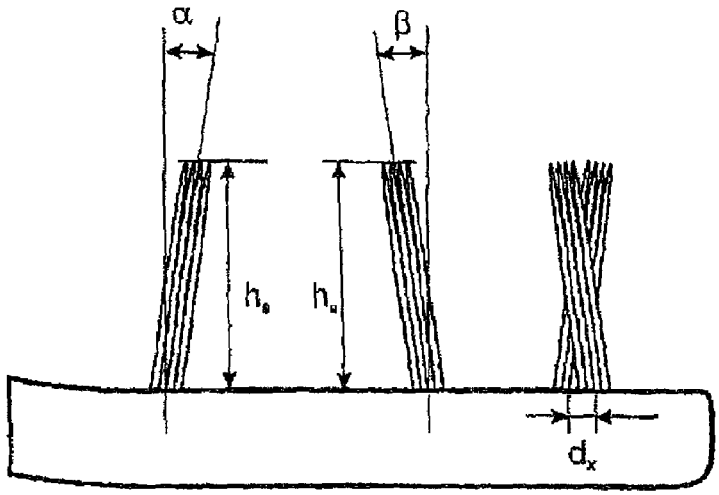
FIG. 1 shows how some variables, used within the framework of the present invention, relating to the inclined and tapered bristle tufts are to be understood.

The term "inclined" means, within the framework of the present application, that an inclined tuft is inclined at an acute angle with respect to an imaginary line standing perpendicularly to the bristle surface, this imaginary line passing through the center point of the hole in the bristle carrier belonging to said tuft. This acute angle may be about 1 to 10°, preferably about 7 to 90 and, more preferably, about 8°. An inclined tuft may therefore be inclined at said acute angle, for example, forward, rearward or to one side. In particular, in one embodiment of the invention it may be preferable that those tufts which stand at the margin of the bristle carrier are inclined outward at said acute angle so as to project away from the bristle carrier, thus allowing a better cleaning of the gums.

Preferably, however, "inclined" means that the tuft in question is inclined forward or rearward, in particular that all the inclined tufts are inclined forward or rearward. The term "inclined rearward" means within the framework of the present application that a rearwardly inclined tuft is inclined at the acute angle toward the grip part, as seen in the longitudinal direction of the bristle carrier, and the term "forwardly inclined" means within the framework of the present application, that a forwardly inclined tuft is inclined at the acute angle away from the grip part, as seen in the longitudinal direction of the bristle carrier.

The brush head of the invention has a surface which may be planar or curved, and which has the holes intended for receiving the tufts. In the finished brush head the bristle tufts project out of this surface. This surface is designated as the "bristle surface".

In the inclined tufts at least some of the bristles are tapered. The term "at least some" is understood within the framework of the application, to mean that preferably at least 50% and, more preferably, at least 80% of the bristle tips are tapered. Particularly preferably, all the bristle tips in the inclined tufts are tapered.

Likewise preferably, the brush heads according to the invention also comprise besides inclined tufts one or more tufts which project vertically out of the bristle surface and which are not inclined with respect to an imaginary line which stands perpendicularly to the bristle surface and which passes through the center point of the hole, belonging to said tuft, in the bristle carrier. These tufts projecting vertically out of the bristle surface preferably contain only non-tapered bristles.

Preferably, the tufts of the brush head according to the invention are arranged in transverse rows running transversely with respect to its longitudinal direction, whereby only forwardly inclined tufts with tapered bristles or only rearwardly inclined tufts with tapered bristles or only bristle tufts projecting vertically out of the bristle surface are present in each transverse row, and whereby at least one transverse row of forwardly or rearwardly inclined tufts with tapered bristles and at least one transverse row of tufts projecting vertically out of the bristle surface and comprising non-tapered bristles is present.

Preferably, the tufts of the brush head according to the invention have a circular cross section.

The term "tapered bristle" is conventional among specialists and designates an, in particular, cylindrical bristle, the ends of which are reduced in diameter by means of chemical etching (for example, with sulfuric acid or with sodium hydroxide solution) or by means of mechanical tapering in such a way that the bristle acquires an approximately conical profile tapering towards its end. If both ends of the bristle are treated in this way, a "two-sidedly tapered bristle" is referred to, otherwise a "one-sidedly tapered bristle". Details of production methods for tapered bristles are described in various publications; reference is made, for example, to EP-A-1 234 525, to Korean patent number 130932 and to US-A-2004/0070258. Tapered bristles suitable for the present invention are also obtainable on the market, for example from the manufacturer's Sogo, Hylon, Best Whasung, Cheil Jedang, Lion and Wessen.

Preferably, the tapered ends of the bristles are bodies of revolution tapering toward their pointed end and rotationally symmetrically about a center axis of the bristle. In this case, the tapered bristles particularly preferably have a profile (i.e. a diameter of the body of revolution as a function of the distance from the pointed end) which corresponds approximately to the numerical values from one of the following Tables 1 to 4. These Tables list the mean diameters of the bristles as a function of the distance from the pointed end. These Tables indicate as a "diameter range" a typical standard diameter deviation determined from several specimens of the bristle; this standard deviation may also be considered as range limits of the diameter for these four profiles particularly preferred according to the invention.

TABLE 1

| | Distance from the pointed end [mm] | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter [mm] | 0.019 | 0.066 | 0.107 | 0.147 | 0.172 | 0.183 | 0.190 | 0.195 | 0.197 | 0.199 | 0.201 | 0.203 | 0.202 |
| Diameter range [+/− mm] | 0.005 | 0.006 | 0.012 | 0.019 | 0.021 | 0.20 | 0.019 | 0.014 | 0.014 | 0.014 | 0.012 | 0.011 | 0.010 |

TABLE 2

| | Distance from the pointed end [mm] | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter [mm] | 0.017 | 0.086 | 0.140 | 0.172 | 0.185 | 0.192 | 0.198 | 0.201 | 0.204 | 0.205 | 0.205 | 0.208 | 0.209 |
| Diameter range [+/− mm] | 0.005 | 0.012 | 0.018 | 0.021 | 0.018 | 0.015 | 0.013 | 0.010 | 0.009 | 0.008 | 0.008 | 0.007 | 0.006 |

TABLE 3

| | Distance from the pointed end [mm] | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter [mm] | 0.014 | 0.058 | 0.096 | 0.127 | 0.151 | 0.170 | 0.183 | 0.191 | 0.199 | 0.202 | 0.206 | 0.208 | 0.209 |
| Diameter range [+/− mm] | 0.001 | 0.003 | 0.009 | 0.009 | 0.009 | 0.008 | 0.007 | 0.006 | 0.008 | 0.005 | 0.006 | 0.005 | 0.003 |

TABLE 4

| | Distance from the pointed end [mm] | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter [mm] | 0.0204 | 0.0691 | 0.112 | 0.137 | 0.150 | 0.156 | 0.159 | 0.162 | 0.163 | 0.164 | 0.165 | 0.165 | 0.166 |
| Diameter range [+/− mm] | 0.022 | 0.013 | 0.010 | 0.011 | 0.009 | 0.009 | 0.008 | 0.008 | 0.007 | 0.007 | 0.007 | 0.007 | 0.007 |

The tapered bristles may consist of any material which is normally used for tapered toothbrush bristles. Preferably the bristles are produced from a polyester, in particular from a poly($C_2$-$C_8$)alkyleneterephthalate, the ($C_2$-$C_8$)alkylene being unbranched. Polyethyleneterephthalate, polypropyleneterephthalate, polybutyleneterephthalate and polypentylene-terephthalate are more preferred as bristle materials; polybutyleneterephthalate is particularly preferred.

The non-tapered part of the tapered bristles may, if it is cylindrical, have a diameter of about 0.15 to 0.25, preferably of about 0.17 to 0.20 mm.

The non-tapered bristles may consist of any material which is customarily used for toothbrush bristles. Preferably, the non-tapered bristles consist of a polyamide, in particular of a polyamide which is produced from an unbranched ($C_2$-$C_8$)-1,ω-diamine and an unbranched ($C_4$-$C_{14}$)-1,ω-dicarboxylic acid. Polydimethyleneadipinamide, polytrimethyleneadipinamide, polytetramethyleneadipinamide, polypentamethylene-adipinamide, polyhexamethyleneadipinamide, polydimethylenedodecanamide, polytrimethylenedodecanamide, polytetramethylenedodecanamide, polypentamethylenedodecanamide and polyhexamethylenedodecanamide are more preferred as bristle materials. Polyhexamethylenedodecanamide is particularly preferred.

The non-tapered bristles are preferably cylindrical and then preferably have a diameter of about 0.15 to about 0.20, preferably about 0.17 to about 0.19 mm.

The brush head according to the invention may be used for a manual toothbrush or for an electric toothbrush. In this case the bristles attached to the brush head are set in motion either by hand movements, by a motor drive or by sound waves.

The brush heads according to the invention can be produced in a similar way to the production of brush heads already known.

To produce the tufts, one-sidedly or two-sidedly tapered bristles may be used.

The holes of the bristle carrier which serve for receiving the tufts may have previously been drilled into the bristle carrier at any desired angle $\alpha$ or $\beta$, but they may also preferably be produced directly during the production of the bristle carrier by injection molding using hole punches. The holes are preferably of circular cross section in order to make the preferred circular tuft cross section possible.

If two-sidedly tapered and non-tapered bristles are used together mixed in any desired ratio in a tuft, the tuft is preferably anchored in a hole of the bristle carrier by means of a small anchor plate or a loop. In this case, all the bristles of the tuft which is formed are bent in a u-shape within the hole so that both ends of each bristle project out of the hole. Here, as a rule, the holes are not continuous. The fraction of tapered ends of the tuft, here, is equal to the employed fraction of doubly tapered bristles.

If in a tuft one-sidedly tapered and non-tapered bristles are used in admixture or only non-tapered bristles are used, the tuft may, on the one hand, be anchored in the hole as described above, or, on the other hand, be produced by means of the known AFT ("anchor-free tufting") method. In this method, the bristles are introduced into a small carrier plate which has continuous holes, and the bristles of each tuft are welded to one another at the rear hole orifice by means of a heating pad. The bristles then project out of the front hole orifice of the small carrier plate. The small plate provided with the tufts can then be cast or welded into a bristle head. Details of this method are described, for example, in EP-A-0 405 204. To produce a mixed trim of vertical/inclined tufts, preferably a plurality of small carrier plates are used, which initially have vertical holes, but which after the AFT insertion of the bristles are welded to one another at suitable angles (see also WO-A-2004/056235). The composite small carrier plate produced in this way can, again, be cast or welded into a brush head. In the production variant with anchoring, the fraction of tapered ends in the tuft is equal to half the employed fraction of one-sidedly tapered bristles which is used; when the AFT method is used, it is exactly equal to this employed fraction.

Tufts which only contain non-tapered bristles are preferably trimmed according to the invention to a uniform height. Tufts which contain tapered and non-tapered bristles in admixture or only tapered bristles are preferably not trimmed according to the invention. To produce prototypes, the selective trimming of the tufts which contain only non-tapered bristles can be carried out most simply by means of small pointed shears, for example microscopic shears. On a mass production scale the steps of implanting the tufts comprising only non-tapered bristles, of trimming and of optional rounding of the bristles of these tufts and, finally, of implanting of the inclined tufts consisting completely or partially of tapered bristles can be carried out in the indicated order in separate successive operations. The machines and process engineering details for each step are known to the person skilled in the art.

Preferred embodiments of the invention are described with reference to FIGS. 1, 2, 3, 4 and 5.

Figure 2:
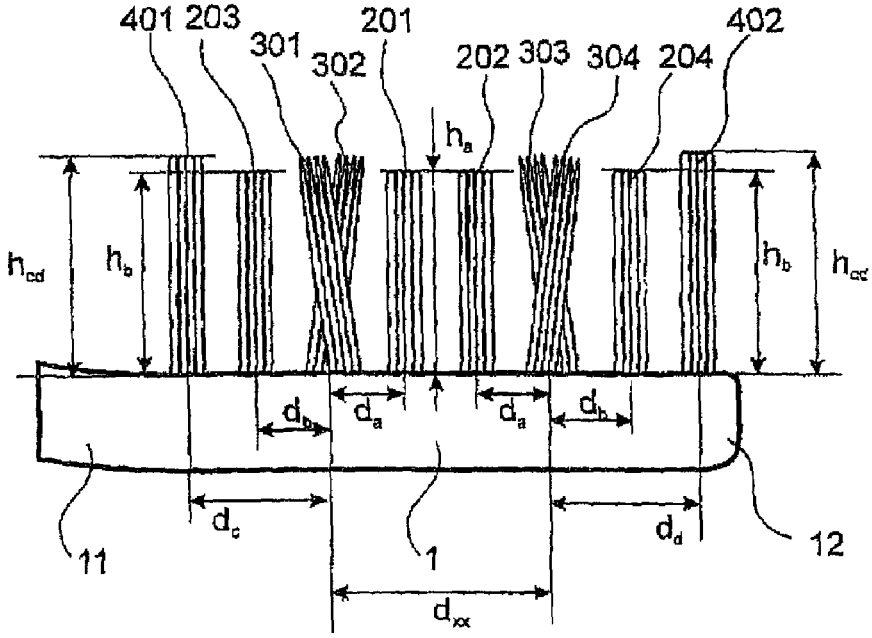
FIGS. 2 and 3 show two embodiments of the bristle head according to the invention.
Figure 3:
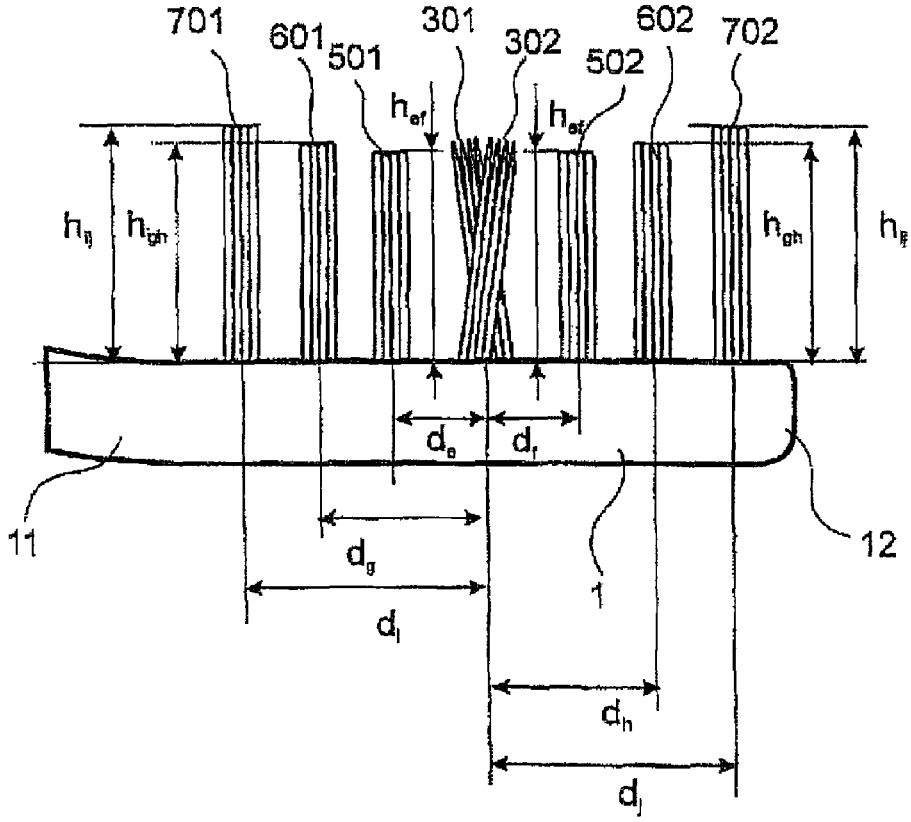
Figure 4:
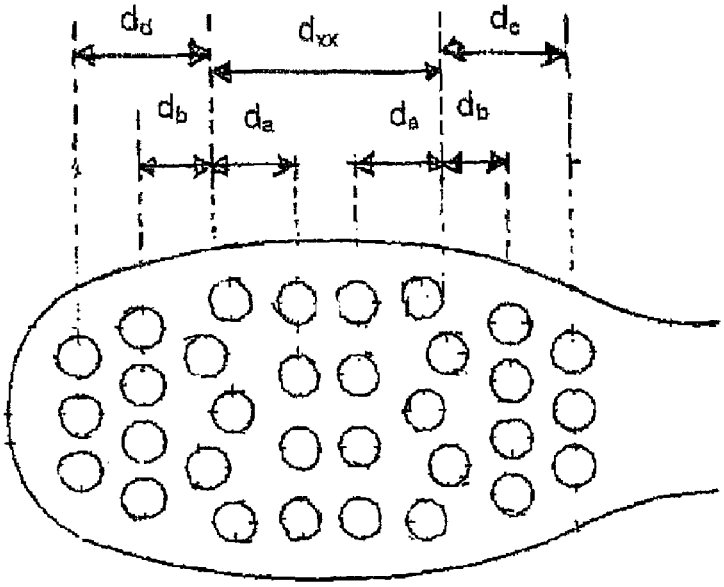
FIGS. 4 and 5 show two embodiments of the arrangement of the tuft holes on the bristle carrier, which arrangement is particularly suitable for brush heads according to FIGS. 2 and 3.

For these preferred embodiments distances between tufts are understood such that the measurement is carried out at the level of the bristle surface of the bristle carrier, between the center axes of the two tufts. Further, distances "in the longitudinal direction of the brush head" between two transverse rows of tufts are understood such that the distance in the longitudinal direction between a first line, which connects the center axes of the tufts of the first transverse row to one another, and a second line, which connects the center axes of the tufts of the second transverse row to one another, is measured, at the level of the bristle surface of the bristle carrier. This concerns, for example, the distance $d_x$ shown in FIG. 1. In the figures the center axes of the tufts are indicated by dashed lines. The distance "in the longitudinal direction of the brush head" between an arbitrary transverse row of tufts and a double row of tufts crossed over in an x-shaped manner is the mean value from a) the distance "in the longitudinal direction of the brush head" between the arbitrary transverse row and the one transverse row forming the double row and b) the distance "in the longitudinal direction of the brush head" between the arbitrary transverse row and the second transverse row forming the double row. This concerns the distances $d_a$, $d_b$, $d_c$, $d_d$, $d_e$, $d_f$, $d_g$, $d_h$, $d_i$ and $d_j$ which are shown in FIGS. 2-5. The distance $d_{xx}$ shown in FIGS. 2 and 4 is the mean value from a) the distance between the forwardly inclined transverse row, which is represented by its tuft 302, and the rearwardly inclined transverse row, which is represented by its tuft 303, and b) the distance between the rearwardly inclined transverse row, which is represented by its tuft 301, and the forwardly inclined transverse row, which is represented by its tuft 304.

Figure 5:
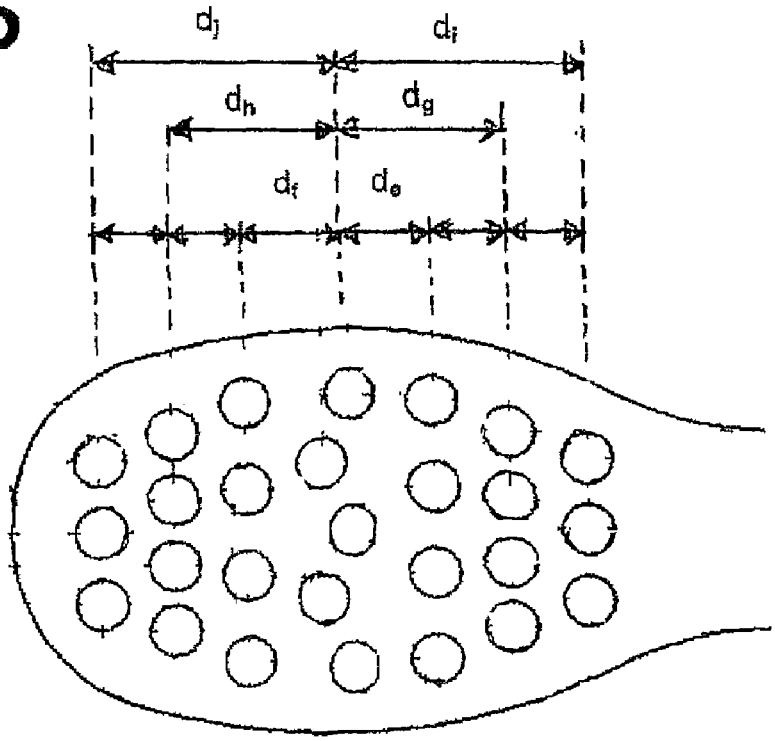

FIGS. 1, 4 and 5 illustrate the definition of some of the above measurement variables. As regards the height $h_s$, it should be noted that this may be a mean height, since the tufts comprising tapered bristles are preferably not trimmed and therefore the individual bristles contained therein may have different heights. This spread of the bristle height is not shown in FIG. 1. This figure also shows that brush heads according to the invention do not necessarily need to have the inclined tufts in the form of an x-shaped crossed-over arrangement; the inclined tuft rows may also be present inclined only either forward or rearward.

These preferred brush heads comprise one or two double rows of tufts crossing over in an x-shaped manner and having tapered bristles. These double rows are each formed by a first transverse row of rearwardly inclined tufts with tapered bristles and by a second transverse row, adjacent to this first transverse row in the direction of the grip part at a distance $d_x$, of forwardly inclined tufts offset with respect to the tufts of the first transverse row in the transverse direction and having tapered bristles (FIGS. 2 and 3). The distance $d_x$ between the forwardly inclined and the rearwardly inclined tuft row is preferably 0.7 to 1.3 mm, more preferably 0.9 to 1.1 mm and particularly preferably about 1.0 mm. The height $h_s$ of the inclined tufts is preferably 11.0 to 14.5 mm, preferably 13.0 to 14.0 mm and particularly preferably about 13.5 mm.

Even more preferably the brush head additionally comprises transverse rows of tufts projecting vertically out of the bristle surface and having non-tapered bristles, such that each double row of tufts crossed over in an x-shaped manner has adjacent to it in each case a vertical transverse row in the longitudinal direction toward the grip part and in each case a further vertical transverse row in the longitudinal direction toward the head part.

If exactly two double rows of tufts crossed over in an x-shaped manner are present (FIG. 2), these are preferably separated from one another at a distance $d_{xx}$ in the longitudinal direction of about 8.0 to 10.0 mm, more preferably 8.5 to 9.5 mm and particularly preferably about 8.9 mm. Of said transverse rows of vertical tufts which are adjacent to the double rows (then, overall, four vertical transverse rows), two of these lie between the double rows in the form of a first and of a second middle transverse row, and the other two lie outside the two double rows and form an inner transverse row (in the direction of the grip part 11) and an outer transverse row (in the direction of the head part 12). The distance $d_a$ between the double rows of bristles crossed over in an x-shaped manner and the middle transverse rows is preferably 2.5 to 4.0 mm, more preferably 3.0 to 3.5 mm and particularly preferably about 3.2 mm. The preferably trimmed height $h_a$ of the tufts of said middle transverse rows is preferably 9.0 to 11.0 mm, more preferably 9.5 to 10.5 mm and particularly preferably about 10.0 mm. The distance $d_b$ of said inner and outer transverse row from the respective double row is preferably 2.5 to 3.5 mm, more preferably 2.7 to 3.3 mm and particularly preferably about 3.0 mm. The preferably trimmed height $h_b$ of the tufts of said inner and outer transverse rows is preferably 9.0 to 11.0 mm, more preferably 9.5 to 10.5 mm and particularly preferably about 10.0 mm.

If exactly one double row of tufts crossed over in an x-shaped manner is present (FIG. 3), said two transverse rows of vertical tufts which are adjacent to the double row form an inner transverse row, which is at a distance $d_e$ from the double row in the direction of the grip part 11, and an outer transverse row which is at a distance $d_f$ from the double row in the direction of the head part 12. The distances $d_e$ and $d_f$ are preferably 3.0 to 4.5 mm and more preferably 3.0 to 4.0 mm. Particularly preferably $d_e$ is about 3.2 mm and $d_f$ about 3.1 mm. The preferably trimmed height $h_{ef}$ of the tufts of the inner and outer transverse row is preferably 9.0 to 11.0, more preferably 9.0 to 10.0 and particularly preferably about 10.0 mm.

A first particularly preferred embodiment of the brush head of the invention (FIGS. 1, 2 and 4) has a first double row of inclined bristle tufts crossed over in an x-shaped manner, the bristles of which are tapered and non trimmed. It is formed by a first transverse row of three rearwardly inclined bristle tufts (represented by its foremost tuft 301) and by a second transverse row of two forwardly inclined tufts (represented by its foremost tuft 302). The distance $d_x$ which the two transverse rows forming said double row have from one another in the longitudinal direction of the brush head is about 1 mm. The height $h_s$ of the inclined tufts is about 13.5 mm, and the angles $\alpha$ and $\beta$, at which the forwardly and rearwardly inclined tufts are inclined, amount respectively to about +8° and about −8° (definitions of $d_x$, $h_s$ $\alpha$ and $\beta$ according to FIG. 1). A second identical double row of tufts crossed over in an x-shaped manner is arranged at a distance do in the direction of the head part 12 of about 8.9 mm from the first double row just described. It is formed by a third transverse row of two rearwardly inclined tufts (represented by its foremost tuft 303) and by a fourth transverse row of three forwardly inclined tufts (represented by its foremost tuft 304). In the four transverse rows which form the two double rows, the distances between the tufts in the transverse direction amount to about 4.5 mm. A first middle transverse row of four vertical tufts with non-tapered bristles trimmed to a uniform height $h_a$ is present at a distance $d_a$ in the longitudinal direction towards the head part 12 of about 3.2 mm from the first double row. A second middle transverse row of four vertical tufts with non-tapered bristles trimmed to a uniform height $h_a$ is present at a distance $d_a$ in the longitudinal direction towards the grip part 11 of about 3.2 mm from the second double row. In these middle transverse rows the distances between the tufts in the transverse direction amount to about 2.9 mm and the height $h_a$ amounts to about 10.0 mm. An inner transverse row of four tufts projecting vertically upward from the brush body and having non-tapered bristles trimmed to a uniform height $h_b$ is arranged at a distance $d_b$ of about 3.0 mm from the first double row in the longitudinal direction of the brush head towards the grip part 11. An outer transverse row of four tufts projecting vertically upward from the brush body and having non-tapered bristles trimmed to a uniform height $h_b$ is arranged at a distance $d_b$ of about 3.0 mm from the second double row in the longitudinal direction of the brush head towards the head part 12. In this inner and outer transverse row, the distances between the tufts in the transverse direction amount to about 2.3 mm and the height $h_b$ of the tufts amounts to about 10 mm. An innermost transverse row of three vertical tufts with non-tapered bristles trimmed to a uniform height $h_{cd}$ is arranged at a distance $d_c$ in the longitudinal direction of the brush head toward the grip part 11 of about 5.5 mm from the first double row. An outermost transverse row of three vertical tufts with non-tapered bristles trimmed to a uniform height $h_{cd}$ is arranged at a distance $d_d$ in the longitudinal direction of the brush head toward the head part 12 of about 5.4 mm from the second double row. The height $h_{cd}$ of the tufts of the innermost and outermost transverse row amounts to about 11 mm and the distance between them in the transverse direction amounts to about 2.3 mm. This affords a trim of a total of 32 tufts (10 inclined tufts with tapered bristles, 16 vertical tufts with non-tapered bristles and 6 vertical tufts with non-tapered bristles, but elevated somewhat in relation to the previous 16 tufts near the grip part 11 and the head part 12). All bristles have a circular cross section over their entire length; the tapered parts of the tapered bristles are therefore bodies of revolution. The diameter $D_n$ of all non-tapered bristles and the maximum diameter $D_z$ of all tapered bristles amount to about 0.175 mm. All tufts have a circular cross section; the diameter of all the tufts amounts to about 1.7 mm.

Further particularly preferred embodiments of the brush head according to the invention may be configured in a similar way to the above-described embodiment, as described in the following Table 5. In these further embodiments, all the numerical parameters which are not given are as in the above-described first embodiment. The meaning of the variables at the column heads is the same as in the above-described first embodiment. The column "$Trim_{cd}$" indicates the type of bristles in the tufts of said innermost and outermost transverse row: "n" means "non-tapered, trimmed to uniform height" and "z" means "tapered".

TABLE 5

| Embodiment No. | $h_a$ (mm) | $h_b$ (mm) | $h_{cd}$ (mm) | $Trim_{cd}$ | $h_s$ (mm) | $D_n$ (mm) | $D_z$ (mm) |
|---|---|---|---|---|---|---|---|
| 2 | 10 | 10 | 11.15 | n | 11.4 | 0.175 | 0.175 |
| 3 | 10 | 10 | 10 | n | 11.4 | 0.175 | 0.175 |
| 4 | 10 | 10 | 11 | n | 12.5 | 0.175 | 0.175 |
| 5 | 9 | 9 | 10 | n | 11.5 | 0.175 | 0.175 |
| 6 | 9 | 9 | 10 | n | 11.5 | 0.15 | 0.175 |
| 7 | 10 | 10 | 11.8 | z | 11.4 | 0.175 | 0.175 |
| 8 | 9 | 9 | 11.5 | z | 11.5 | 0.175 | 0.175 |
| 9 | 9 | 9 | 11.5 | z | 11.5 | 0.15 | 0.175 |
| 10 | 10 | 10 | 11.5 | z | 11.5 | 0.15 | 0.175 |
| 11 | 10 | 10 | 11.5 | z | 12.5 | 0.175 | 0.175 |

Referring to FIGS. 1, 3 and 5, a further particularly preferred twelfth embodiment of the brush head of the invention is described. This brush head has a first double row of inclined and tapered bristle tufts crossing over in an x-shaped manner, as described in the first embodiment (represented by the foremost tufts 301, 302). The rearwardly inclined transverse row (tuft 301) has two tufts at a distance of about 4.6 mm in the transverse direction and the forwardly inclined row (tuft 302) has three tufts each also at a distance of about 4.6 mm in the transverse direction. The distance $d_x$ between the rearwardly inclined and the forwardly inclined transverse row in the longitudinal direction of the brush head amounts to about 1 mm. The height $h_s$ of the inclined tufts amounts to about 13.5 mm, and the angles α and β, at which the forwardly and the rearwardly inclined tufts are inclined, amount respectively to about +8° and to about −8° (definitions of $d_x$, $h_s$, α and β according to FIG. 1). An inner transverse row of four tufts with non-tapered bristles trimmed to a uniform height $h_{ef}$ is arranged at a distance $d_e$ of about 3.2 mm in the longitudinal direction toward the grip part 11 from the first double row. An outer transverse row four tufts with non-tapered bristles trimmed to a uniform height $h_{ef}$ is arranged at a distance $d_f$ of about 3.1 mm in the longitudinal direction toward the head part 12 from the first double row. In the inner and outer transverse row the distances between the tufts in the transverse direction amount to about 2.9 mm and the heights $h_{ef}$ to about 10 mm. A further inner transverse row of four tufts with non-tapered bristles trimmed to a uniform height $h_{gh}$ is arranged at a distance $d_g$ of about 5.7 mm in the longitudinal direction toward the grip part 11 from the first double row. A further outer transverse row of four tufts with non-tapered bristles trimmed to a uniform height $h_{gh}$ is arranged at a distance $d_h$ of about 5.6 mm in the longitudinal direction toward the head part 12 from the first double row. In the further inner transverse row and the further outer transverse row the distances between the tufts in the transverse direction amount to about 2.9 mm and the height $h_{gh}$ amounts to about 11 mm. An innermost transverse row of three tufts with non-tapered bristles trimmed to a uniform height $h_{ij}$ is arranged at a distance $d_i$ of about 8.2 mm in the longitudinal direction toward the grip part 11 from the first double row. An outermost transverse row of three tufts with non-tapered bristles trimmed to a uniform height $h_{ij}$ is arranged at the distance $d_j$ of about 8.0 mm in the longitudinal direction toward the head part 12 from the first double row. In the innermost and the outermost transverse row, the distances between the tufts in the transverse direction amount to about 2.4 mm and the height $h_{ij}$ amounts to about 11.5 mm. This affords a trim of a total of 27 tufts (5 inclined tufts with tapered bristles, 8 vertical tufts with non-tapered bristles, 8 vertical tufts with non-tapered tufts, but elevated somewhat in relation to the previous 8 tufts, and 6 vertical tufts, still elevated further somewhat, with non-tapered bristles, adjacent to the grip part 11 and to the head part 12). All bristles have a circular cross section over their entire length; the tapered parts of the tapered bristles are therefore bodies of revolution. The diameter $D_n$ of all non-tapered bristles and the maximum diameter $D_z$ of all tapered bristles amount to about 0.175 mm. All the tufts have a circular cross section; the diameter of the all tufts amounts to about 1.7 mm.

Further exemplary embodiments of the brush head according to the invention may be configured in a similar way to the above-described twelfth embodiment, as described in the following Table 6. In these further embodiments, all the numerical parameters which are not given are the same as in the above-described twelfth embodiment. The meaning of the variables at the column heads is the same as in the above-described twelfth embodiment.

TABLE 6

| Embodiment No. | $h_{ef}$ (mm) | $h_{gh}$ (mm) | $h_{ij}$ (mm) | $h_s$ (mm) | $D_n$ (mm) | $D_z$ (mm) |
|---|---|---|---|---|---|---|
| 13 | 10 | 11 | 11.5 | 11.4 | 0.175 | 0.175 |
| 14 | 10 | 11 | 11.5 | 12.5 | 0.175 | 0.175 |
| 15 | 9 | 10 | 10.5 | 11.5 | 0.175 | 0.175 |
| 16 | 9 | 10 | 10.5 | 11.5 | 0.15 | 0.175 |
| 17 | 9 | 9 | 10 | 11.5 | 0.15 | 0.175 |
| 18 | 10 | 10 | 11 | 12.5 | 0.175 | 0.175 |

Figure 6:
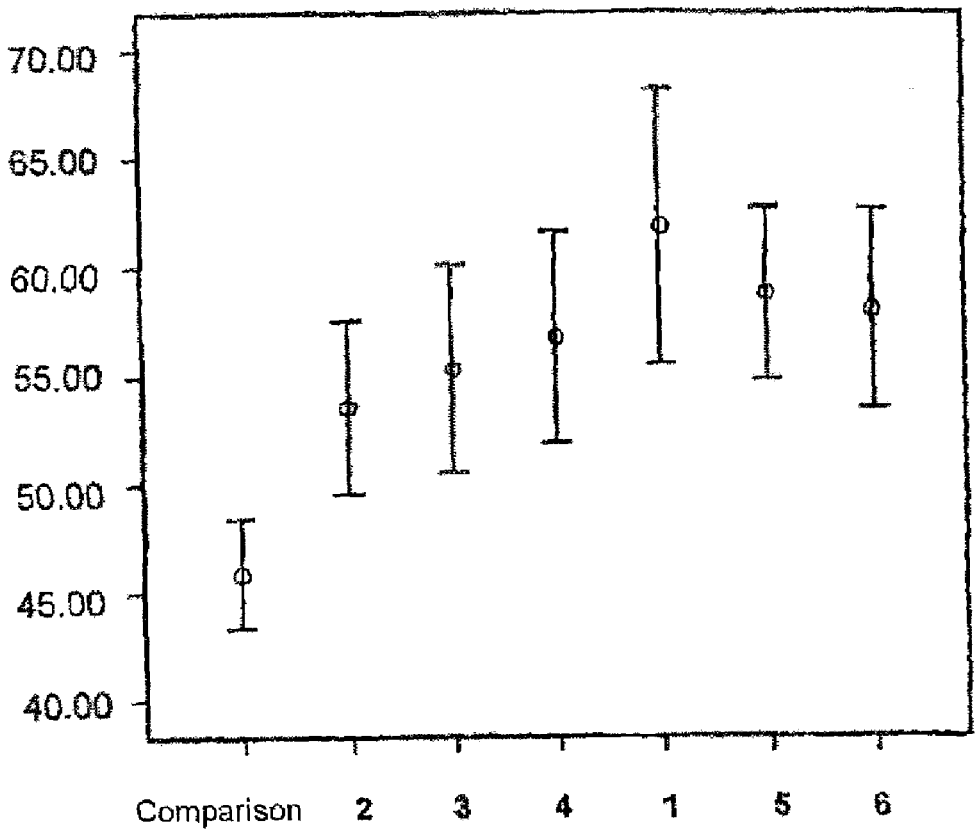
FIGS. 6, 7 and 8 show the measurement values of the cleaning performances which were achieved with various brush heads according to the invention.
Figure 7:
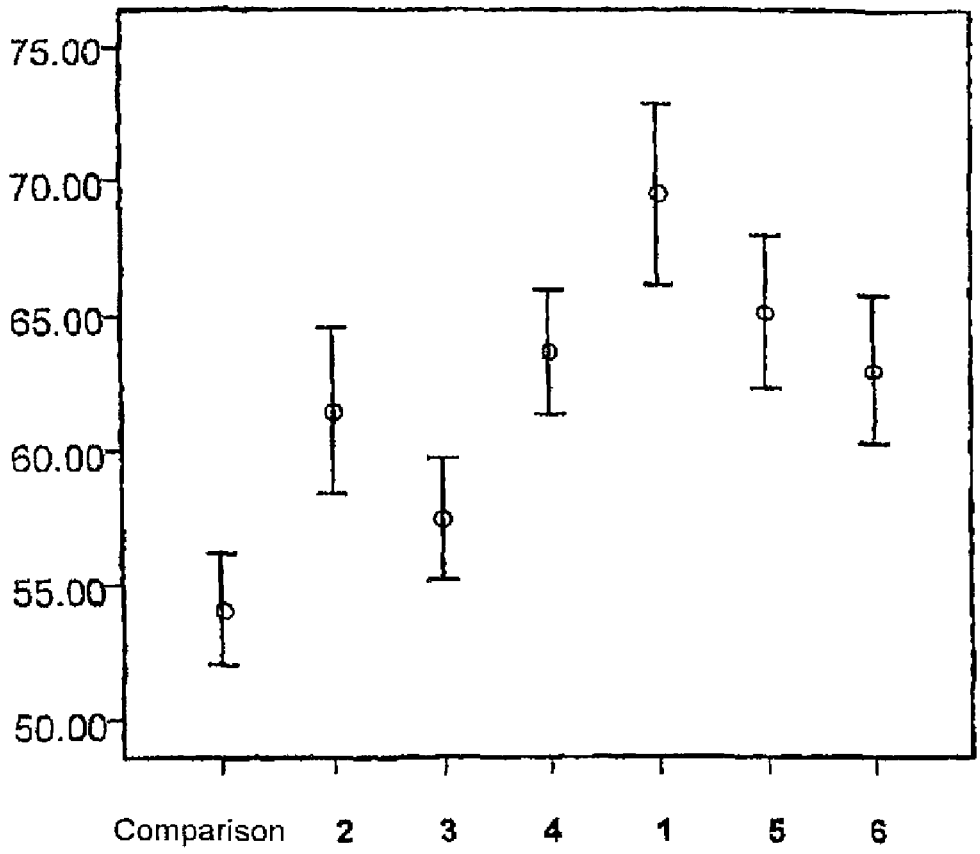
Figure 8:
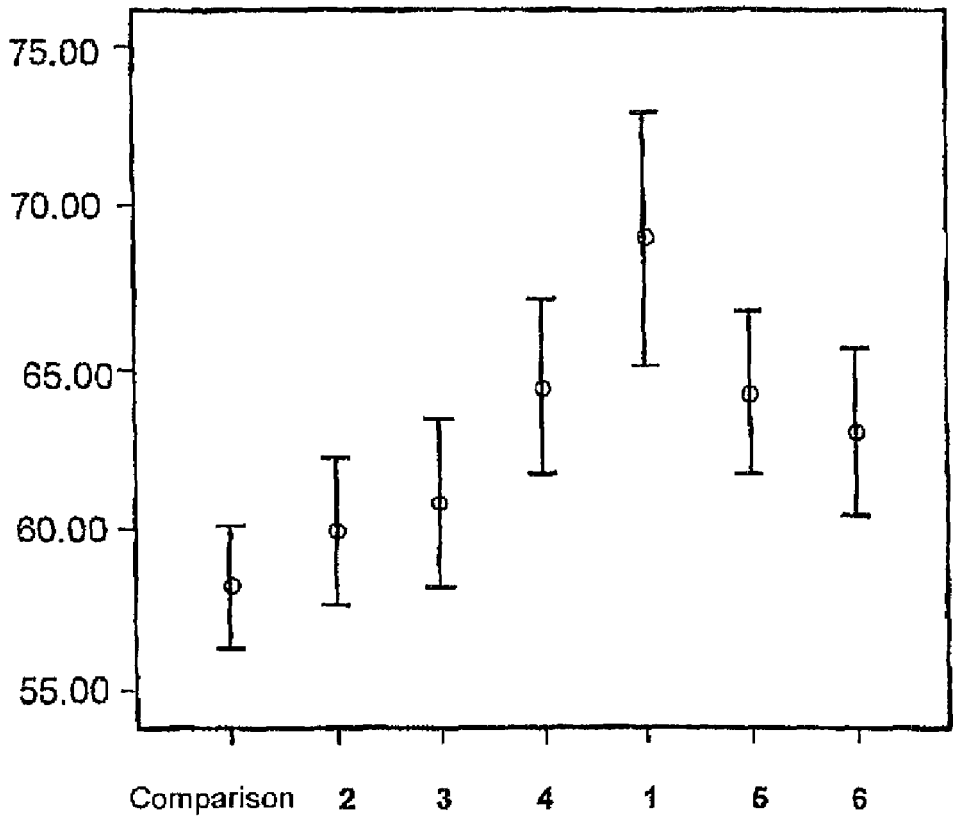

FIGS. 6, 7 and 8 show the cleaning performances which were achieved with various embodiments of the brush head according to the invention in the case of a horizontal, vertical and circular cleaning movement. In these tests, the teeth of a model of an upper jaw sextant (with 3 molars, 2 front molars and 1 incisor) were first colored black and then coated white with a titanium dioxide paste (25 g/v in 26% ethanol). After a standardized brushing operation with the brush heads to be tested, of a duration of 1 minute with a pressing force of 2.45 Newton, the percentage of the tooth surfaces which had been freed of the titanium dioxide paste was determined. In the horizontal cleaning the standardized brushing operation consisted of 60 to-and-fro movements with an amplitude of 30 mm; in the vertical cleaning it consisted of 60 up-and-down movements with an amplitude of 8 mm; and in the circular cleaning it consisted of 60 circles with a radius of 4 mm, at the same time with 16 horizontal to-and-fro movements with an amplitude of 30 mm.

For each tested brush head type and each of the three cleaning tests, 4 specimens of the brush head were tested in each case on 4 upper jaw sextants. The mean values of the total cleaning performances achieved for the horizontal, vertical and circular cleaning test (as a percentage of the cleaned tooth surface, with a spread) are given in FIGS. 6, 7 and 8 respectively. The numbers of the above-described embodiments of the brush head according to the invention are given on the x-axis of the three figures; the "comparison" lists the corresponding cleaning performance of the brush head of a known brush sold by the applicant (Elmex Inter X Medium). It can be seen that all the brush heads according to the invention are superior to the comparative brush head.

The invention claimed is:

1. A brush head for a toothbrush, said brush head comprising:

a grip part, a head part and a bristle surface with a plurality of bristle tufts inserted therein, each of the bristle tufts comprising a plurality of bristles, a first transverse row of rearwardly inclined bristle tufts with tapered bristles and a second transverse row of forwardly inclined bristle tufts with tapered bristles, the bristle tufts of the first and the second transverse rows forming a first double row of bristle tufts crossing over in an x-shaped manner;

a second double row of bristle tufts crossing over in an x-shaped manner and arranged at a distance $d_{xx}$ from said first double row in the longitudinal direction of the bristle surface toward the head part; and a first middle transverse row of bristle tufts with non-tapered bristles projecting vertically out of the bristle surface and the non-tapered bristles having a uniform height $h_a$, the first middle transverse row arranged at a distance $d_a$ from said first double row in the longitudinal direction of the bristle surface toward the head part.

2. The brush head as claimed in claim 1, wherein the bristle tufts of the second transverse row with forwardly inclined bristle tufts are inclined forward at an angle $\alpha$ of +1 to +10° with respect to a line standing perpendicularly to the bristle surface or the bristle tufts of the first transverse row with rearwardly inclined bristle tufts are inclined rearward at an angle $\beta$ of −1 to −10° with respect to a line standing perpendicularly to the bristle surface.

3. The brush head as claimed in claim 2, wherein the second transverse row is positioned adjacent to the first transverse row in the direction of the grip part and spaced from the first transverse row by a distance in a range of 0.7 mm to 1.3 mm.

4. The brush head as claimed in claim 3 wherein height $h_s$ of the forwardly and of the rearwardly inclined bristle tufts are in a range of 11.0 mm to 14.5 mm.

5. The brush head as claimed in claim 1 wherein the distance $d_{xx}$ is in a range of 8.0 mm to 10.0 mm.

6. The brush head as claimed in claim 1, wherein the distance $d_a$ is in a range of 2.5 mm to 4.0 mm.

7. The brush head as claimed in claim 1, wherein the height $h_a$ of the bristle tufts of said first and second middle transverse rows is in a range of 9.0 mm to 11.0 mm.

8. The brush head as claimed in claim 1 further comprising an inner transverse row of non-tapered bristle tufts projecting vertically out of the bristle surface and having bristles trimmed to a uniform height $h_b$, the inner transverse row of non-tapered bristle tufts arranged at a distance $d_b$ from said first double row in the longitudinal direction of the bristle surface toward the grip part, and an outer transverse row of non-tapered bristle tufts projecting vertically out of the bristle surface and having bristles trimmed to a uniform height $h_b$, the outer transverse row of non-tapered bristle tufts arranged at a distance $d_b$ from said second double row in the longitudinal direction of the bristle surface toward the head part, wherein the distance $d_b$ is in a range of 2.5 mm to 3.5 mm.

9. The brush head as claimed in claim 8, wherein the height $h_b$ of the bristle tufts of said inner and outer transverse rows is in a range of 9.0 mm to 11.0 mm.

10. The brush head as claimed in claim 8 further comprising an innermost transverse row of bristle tufts projecting vertically out of the bristle surface and having tapered or non-tapered bristles, the innermost transverse row of bristle tufts arranged at a distance $d_c$ from said first double row in the longitudinal direction of the bristle surface toward the grip part, wherein the distance $d_c$ is in a range of 5.0 mm to 6.0 mm, and an outermost transverse row of bristle tufts projecting vertically out of the bristle surface and having tapered or non-tapered bristles, the outermost transverse row of bristle tufts arranged at a distance $d_d$ from said second double row in the longitudinal direction of the bristle surface toward the head part, wherein the distance $d_d$ is in a range of 5.0 mm to 6.0 mm.

11. The brush head as claimed in claim 10, wherein the bristles of the bristle tufts of said innermost and outermost transverse rows are non-tapered, and the height $h_{cd}$ of the bristle tufts is in a range of 10.0 mm to 12.0 mm.

12. The brush head as claimed in claim 10, wherein the bristles of the bristle tufts of said innermost and outermost transverse rows are tapered, and the height $h_{cd}$ of the bristle tufts is in a range of 10.5 mm to 12.5 mm.

13. The brush head as claimed in claim 1 further comprising an inner transverse row of bristle tufts projecting vertically out of the bristle surface and having non-tapered bristles, the inner transverse row of bristle tufts arranged at a distance $d_e$ from said first double row in the longitudinal direction of the bristle surface toward the grip part, and an outer transverse row of bristle tufts projecting vertically out of the bristle surface and having non-tapered bristles, the outer transverse row of bristle tufts arranged at a distance $d_f$ from said first double row in the longitudinal direction of the bristle surface toward the head part, wherein the distances $d_e$ and $d_f$ are in a range of 3.0 mm to 4.5 mm.

14. The brush head as claimed in claim 13, wherein the bristle tufts of said inner and outer transverse rows are trimmed to a uniform height $h_{ef}$ of 9.0 mm to 11.0 mm.

15. The brush head as claimed in claim 13 further comprising a second inner transverse row of non-tapered bristle tufts projecting vertically out of the bristle surface, the second inner transverse row of non-tapered bristle tufts arranged at a distance $d_g$ from said first double row in the longitudinal direction of the bristle surface toward the grip part, and a second outer transverse row of non-tapered bristle tufts projecting vertically out of the bristle surface, the second outer transverse row of non-tapered bristle tufts arranged at a distance $d_h$ from said first double row in the longitudinal direction of the bristle surface toward the head part, wherein the distances $d_g$ and $d_h$ are in a range of 5.0 mm to 6.5 mm.

16. The brush head as claimed in claim 15, wherein the bristle tufts of the further inner transverse row and further outer transverse row are trimmed to a uniform height $h_{gh}$ of 10.0 mm to 12.0 mm.

17. The brush head as claimed in claim 15, further comprising an innermost transverse row of non-tapered bristle tufts projecting vertically out of the bristle surface, the innermost transverse row of non-tapered bristle tufts arranged at a distance $d_i$ from said first double row in the longitudinal direction of the bristle surface toward the grip part, and an outermost transverse row of non-tapered bristle tufts projecting vertically out of the bristle surface, the outermost transverse row of non-tapered bristle tufts arranged at a distance $d_j$ from said first double row in the longitudinal direction of the bristle surface toward the head part, wherein the distances $d_i$ and $d_j$ are in a range of 7.5 mm to 9.0 mm.

18. The brush head as claimed in claim 17, wherein the bristle tufts of said innermost and outermost transverse rows are trimmed to a uniform height $h_{ij}$ of 10.5 mm to 12.5 mm.

19. The brush head as claimed in claim 1, wherein all tapered bristles consist of a poly($C_2$-$C_8$)alkyleneterephthalate and in that all non-tapered bristles consist of a polyamide produced from an unbranched ($C_2$-$C_8$)-1,ω-diamine and an unbranched ($C_4$-$C_{14}$)-1,ω-dicarboxylic acid.

* * * * *